US010645481B2

(12) United States Patent
Zeng et al.

(10) Patent No.: US 10,645,481 B2
(45) Date of Patent: May 5, 2020

(54) EARPHONE CONTROL DEVICE, EARPHONE AND CONTROL METHOD FOR EARPHONE

(71) Applicant: BOE TECHNOLOGY GROUP CO., LTD., Beijing (CN)

(72) Inventors: Qi Zeng, Beijing (CN); Xueyun Wang, Beijing (CN); Xitong Ma, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/939,881

(22) Filed: Mar. 29, 2018

(65) Prior Publication Data

US 2019/0028792 A1 Jan. 24, 2019

(30) Foreign Application Priority Data

Jul. 21, 2017 (CN) ..... 2017 1 0601270

(51) Int. Cl.
*H04R 1/10* (2006.01)
*H04R 1/40* (2006.01)
(Continued)

(52) U.S. Cl.
CPC ..... *H04R 1/1041* (2013.01); *G08B 3/10* (2013.01); *G08B 21/02* (2013.01); *G10L 25/51* (2013.01); *H04R 1/406* (2013.01); *H04R 3/005* (2013.01); *H04R 3/04* (2013.01); *H04R 5/033* (2013.01); *H04R 29/001* (2013.01); *H04R 1/1083* (2013.01); *H04R 2420/01* (2013.01); *H04R 2430/01* (2013.01); *H04R 2460/01* (2013.01)

(58) Field of Classification Search
CPC ..... H04R 1/1083; H04R 2225/41; H04R 2460/01; G10K 11/178; G10K 2210/1081; G10K 2210/108
See application file for complete search history.

(56) References Cited

U.S. PATENT DOCUMENTS 9,663,031 B2 * 5/2017 Censo ..... B60Q 5/006
2001/0046304 A1 * 11/2001 Rast ..... H04R 1/1041 381/74
(Continued)

FOREIGN PATENT DOCUMENTS

CN 101840700 A 9/2010
CN 105611461 A 5/2016
(Continued)

OTHER PUBLICATIONS

First Chinese Office Action dated Nov. 21, 2018.
Second Chinese Office Action dated Nov. 18, 2019.

*Primary Examiner* — Kile O Blair
(74) *Attorney, Agent, or Firm* — Dilworth & Barrese, LLP.; Michael J. Musella, Esq.

(57) ABSTRACT

An earphone control device, an earphone and a control method for the earphone are disclosed. The earphone control device includes: an acquisition module, configured to collect external environment sound; an output module, configured to output a prompt tone to a first sounding unit and/or a second sounding unit of the earphone; and a processing module, configured to determine whether abnormal sound is included in the external environment sound and control the output module to output the prompt tone in a case where the abnormal sound is present.

14 Claims, 4 Drawing Sheets

(51) Int. Cl.

| | |
|---|---|
| ***H04R 3/00*** | (2006.01) |
| ***G08B 21/02*** | (2006.01) |
| ***G10L 25/51*** | (2013.01) |
| ***H04R 29/00*** | (2006.01) |
| ***H04R 3/04*** | (2006.01) |
| ***H04R 5/033*** | (2006.01) |
| ***G08B 3/10*** | (2006.01) |

(56) References Cited

U.S. PATENT DOCUMENTS

| | | | | |
|---|---|---|---|---|
| 2006/0140415 | A1* | 6/2006 | Haussmann | A61F 11/08 381/72 |
| 2006/0140416 | A1* | 6/2006 | Berg | A61F 11/12 381/72 |
| 2010/0290632 | A1* | 11/2010 | Lin | G01S 3/8006 381/56 |

FOREIGN PATENT DOCUMENTS

| | | | |
|---|---|---|---|
| CN | 106162413 | A | 11/2016 |
| CN | 106373325 | A | 2/2017 |
| CN | 106601272 | A | 4/2017 |
| CN | 106604167 | A | 4/2017 |
| CN | 106768284 | A | 5/2017 |

* cited by examiner

EARPHONE CONTROL DEVICE, EARPHONE AND CONTROL METHOD FOR EARPHONE

The present application claims priority to the Chinese patent application No. 201710601270.1, filed Jul. 21, 2017, the entire disclosure of which is incorporated herein by reference as part of the present application.

TECHNICAL FIELD

Embodiments of the present disclosure relates to an earphone control device, an earphone, and a control method for the earphone.

BACKGROUND

Earphones have become common electronic equipments in people's daily life; in particular, anti-interference earphones that can reduce noise are more and more favorable for users. As noise is shielded, users can easily use anti-interference earphones to listen to music or use a telephone in a noisy environment such as subway trains, shopping malls, and roads and so on. On the other hand, however, because the anti-interference earphone shield most of the sound in an external environment, the user may not be able to hear an abnormal sound in the external environment and may not be aware of possible danger and may be harmed.

SUMMARY

At least one embodiment of the present disclosure provides an earphone control device, adaptable for an earphone, comprising: an acquisition module, configured to collect an external environment sound; an output module, configured to output a prompt tone to a first sounding unit and/or a second sounding unit of the earphone; and a processing module, configured to determine whether a abnormal sound is comprised in the external environment sound and control the output module to output the prompt tone in a case where the abnormal sound is present.

For example, in the earphone control device provided by an embodiment of the present disclosure, the processing module is further configured to identify an orientation of the abnormal sound source in the case where the abnormal sound is present, and the output module is configured to output the prompt tone to the first sounding unit and/or the second sounding unit of the earphone according to the orientation of the abnormal sound source.

For example, in the earphone control device provided by an embodiment of the present disclosure, the processing module is further configured to extract a signal corresponding to the abnormal sound and output the signal corresponding to the abnormal sound to the output module such that the prompt tone comprises the abnormal sound.

For example, in the earphone control device provided by an embodiment of the present disclosure, the acquisition module comprises a plurality of sound sensors, a filter amplification unit, and an analog-to-digital conversion unit; the plurality of sound sensors are disposed at different positions on left and right sides of the earphone and configured to collect the external environment sound and output analog sound signals, the filter amplification unit is configured to filter and amplify the analog sound signals, and the analog-to-digital conversion unit is configured to convert the filtered and amplified analog sound signals into digital sound signals.

For example, in the earphone control device provided by an embodiment of the present disclosure, the processing module comprises a storage unit and a control unit; the storage unit is configured to buffer the digital sound signals, and the control unit is configured to determine whether the abnormal sound is comprised in the digital sound signals and to identify the orientation of the abnormal sound source in the case where the abnormal sound is present.

For example, in the earphone control device provided by an embodiment of the present disclosure, the processing module further comprises a filtering unit, and the filtering unit is configured to filter out other sound signals in the digital sound signals except the abnormal sound.

At least one embodiment of the present disclosure further provides an earphone, comprising the earphone control device according to any one embodiment of the present disclosure.

At least one embodiment of the present disclosure further provides a control method for an earphone, comprising: collecting an external environment sound; determining whether an abnormal sound is comprised in the external environment sound; and outputting a prompt tone to a first sounding unit and/or a second sounding unit of the earphone in the case where the abnormal sound is present.

For example, the control method for the earphone provided by an embodiment of the present disclosure further comprises: recognizing an orientation of the abnormal sound source; wherein outputting of the prompt tone to the first sounding unit and/or the second sounding unit of the earphone comprises: outputting the prompt tone to the first sounding unit and/or the second sounding unit of the earphone according to the orientation of the abnormal sound source.

For example, the control method for the earphone provided by an embodiment of the present disclosure further comprises: extracting a signal corresponding to the abnormal sound and outputting the signal corresponding to the abnormal sound to the first sounding unit and/or the second sounding unit of the earphone.

For example, in the control method for the earphone provided by an embodiment of the present disclosure, the collecting of the external environment sound comprises: collecting the external environment sound by using a plurality of sound sensors and outputting analog sound signals; filtering and amplifying analog sound signals by using a filter amplification unit; and converting the filtered and amplified analog sound signals into digital sound signals by using an analog-to-digital conversion unit.

For example, in the control method for the earphone provided by an embodiment of the present disclosure, determining of whether an abnormal sound is comprised in the external environment sound comprises: inputting the digital sound signals into a fixed-size buffer; obtaining an average value of the digital sound signals in the buffer as an environmental noise reference value; and determining whether the energy value of the digital sound signals at a certain moment is greater than a product of the environmental noise reference value and a reference coefficient.

For example, in the control method for the earphone provided by an embodiment of the present disclosure, the environmental noise reference value is updated according to the energy value of the digital sound signals which have been input into the buffer at a timing; and the reference coefficient is modified according to the environmental noise reference value; wherein the control method for the earphone further comprises extracting a frequency range corresponding to the abnormal sound in a case where it is determined that the external environment sound comprises the abnormal sound.

For example, in the control method for the earphone provided by an embodiment of the present disclosure, recognizing of the orientation of the abnormal sound comprises: recognizing the orientation of the abnormal sound source according to moments at which the abnormal sound reaches the plurality of sound sensors, respectively.

For example, in the control method for the earphone provided by an embodiment of the present disclosure, extracting of the signal corresponding to the abnormal sound comprises: using a filtering unit to filter out other sound signals in the digital sound signals except the abnormal sound according to the frequency range.

BRIEF DESCRIPTION OF THE DRAWINGS

In order to clearly illustrate the technical solution of the embodiments of the present disclosure, the embodiments or the drawings of the related technical description will be briefly described in the following, it is obvious that the described drawings are only related to some embodiments of the present disclosure and thus are not limitative of the present disclosure.

DETAILED DESCRIPTION

Figure 1:
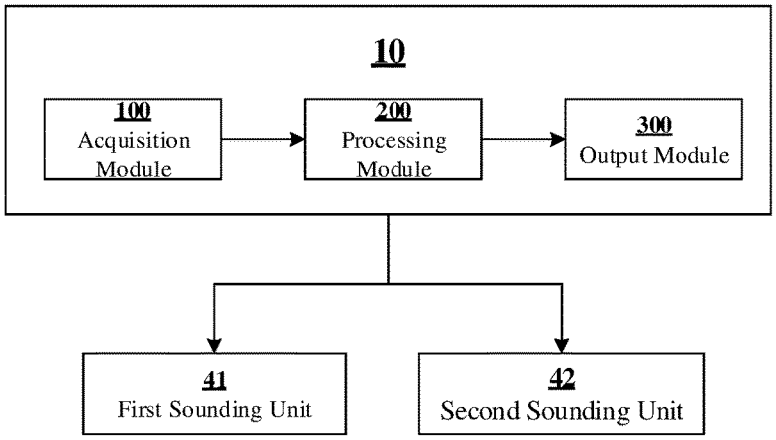
FIG. 1 is a schematic block diagram of an earphone control device provided by an embodiment of the present disclosure.

In order to make objects, technical details and advantages of the embodiments of the invention apparent, the technical solutions of the embodiments will be described in a clearly and fully understandable way in connection with the drawings related to the embodiments of the invention. Apparently, the described embodiments are just a part but not all of the embodiments of the invention. Based on the described embodiments herein, those skilled in the art can obtain other embodiment(s), without any inventive work, which should be within the scope of the invention.

Unless otherwise defined, all the technical and scientific terms used herein have the same meanings as commonly understood by one of ordinary skill in the art to which the present invention belongs. The terms "first," "second," etc., which are used in the description and the claims of the present application for invention, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

At least one embodiment of the present disclosure provides an earphone control device, the earphone control device comprises: an acquisition module, configured to collect an external environment sound; an output module, configured to output a prompt tone to a first sounding unit and/or a second sounding unit of the earphone; and a processing module, configured to determine whether an abnormal sound is comprised in the external environment sound and control the output module to output the prompt tone in a case where the abnormal sound is present. At least one embodiment of the present disclosure further provides an earphone and a control method for the earphone corresponding to the above earphone control device.

When people use anti-interference earphones in noisy environments such as subway trains, shopping malls, streets and the like, they may not be able to hear an abnormal sound in the external environment and may not be aware of possible danger and therefore may be harmed. For example, when people use anti-interference earphones on road, they may be physically injured because a motor vehicle can not brake in time or because they can not hear the whistles of a passing motor vehicle and can not initiatively evade the passing motor vehicle.

It should be noted that the term "abnormal sound" recited in the embodiments of the present disclosure refers to the sound in an external environment that is different from normal environment background noise and emitted by an object or a behavior that may cause injury to a human.

The earphone control device, the earphone and the control method for the earphone provided by the embodiments of the present disclosure can remind the user to notice the abnormal sound in an external environment and avoid possible dangers.

One example of an embodiment of the present disclosure provides an earphone control device 10, which is adaptable for an earphone. As shown in FIG. 1, the earphone control device comprises an acquisition module 100, a processing module 200, and an output module 300.

The acquisition module 100 is configured to collect an external environment sound or external environment sounds, for example, the external environment sound signal collected by the acquisition module 100 is an analog signal, which is converted into a digital sound signal after being collected by the acquisition module and output to the next stage. For example, the acquisition module 100 may be configured to collect the external environment sounds all the time, or may be configured to start acquisition when a user starts to operation and stop acquisition when the user pauses the operation.

The processing module 200 is configured to determine whether an abnormal sound is comprised in the external environment sound. When the processing module is determined that the external environment sound comprises the abnormal sound, the processing module 200 controls the output module 300 to output a prompt tone.

The output module 300 is configured to output the prompt tone to a first sounding unit and/or a second sounding unit of the earphone. For example, when the processing module 200 determines that the abnormal sound is comprised in the external environment sound, the processing module 200 controls the output module 300 to output the prompt tone. For example, the prompt tone may be output to the first sounding unit of the earphone, or to the second sounding unit of the earphone, or to both the first sounding unit and the second sounding unit of the earphone simultaneously.

For example, the first sounding unit of the earphone may be the left sounding unit of the earphone and correspondingly the second sounding unit may be the right sounding unit. For another example, the first sounding unit of the earphone may be the right sounding unit of the earphone, and correspondingly the second sounding unit may be the left sounding unit. Each of the embodiments of the present disclosure are described by using the first sounding unit as the left sounding unit as an example, and details are not described herein again.

For example, the prompt tone may be a pre-recorded artificial sound such as "watch out, watch out, watch out", "di, di, di" and the like; for another example, the prompt tone may be a piece of pre-recorded machine sound, such as siren sound. The embodiments of the present disclosure include, but are not limited to the above examples, and any sound can be used as the prompt tone as long as the sound can play the role of reminding the user.

The earphone control device provided by this embodiment collects the external environment sound and determines whether an abnormal sound is comprised in the external environment sound by processing the external environment sound and outputs the prompt tone to a sounding unit of the earphone in the case where the abnormal sound is present so that the user can hear the prompt message. The sound control device may remind the user to pay attention to the abnormal sound in the external environment and avoid possible dangers.

For example, in the earphone control device 10 provided by another example of this embodiment, as shown in FIG. 1, the processing module 200 is further configured to identify the orientation of the abnormal sound source of an abnormal sound in the case where the abnormal sound is present. The output module 300 is configured to output the prompt tone to the first sounding unit and/or the second sounding unit of the earphone according to the orientation of the abnormal sound source.

For example, the abnormal sound is a car whistle, and when the car is on the left side of the user, and the processing module 200 can identify that the orientation of the abnormal sound source is on the left side of the user and then controls the output module 300 to output the prompt tone to the left sounding unit of the earphone; when the car is on the right side of the user, and the processing module 200 can identify that the orientation of the abnormal sound source is on the right side of the user and then controls the output module 300 to output the prompt tone to the right sounding unit of the earphone; when the car is directly in front of or behind the user, and the processing module 200 can identify that the orientation of the abnormal sound source is directly in front of or behind the user and then controls the output module 300 to output the prompt tone to the left sounding unit and the right sounding unit of the earphone simultaneously.

By identifying the orientation of the abnormal sound source and outputting the prompt tone to the corresponding sounding unit of the earphone according to the orientation of the abnormal sound source, the user can be reminded with the orientation of the danger source so that the user can better avoid possible danger.

For example, in the earphone control device 10 provided by another example of this embodiment, as shown in FIG. 1, the processing module 200 may be further configured to extract a signal corresponding to the abnormal sound and output the signal corresponding to the abnormal sound to the output module 300 so that the prompt tone comprises the abnormal sound.

For example, when the processing module 200 determines that the abnormal sound is comprised in the external environment sound, the processing module 200 extracts the signal (such as a digital sound signal) corresponding to the abnormal sound and outputs the signal to the output module 300, so that the prompt tone comprises the digital sound signal corresponding to the abnormal sound, and then the output module 300 outputs the prompt sound to the sounding unit of the earphone. It should be noted that, in this case, the prompt tone may comprise only the digital sound corresponding to the abnormal sound, or the prompt tone may also comprise the above-mentioned pre-recorded artificial sound or machine sound.

Through the above method of extracting the abnormal sound and outputting the abnormal sound to the sounding unit of the earphone, the abnormal sound can be directly output to the user to intuitively remind the user, so that the user can better avoid the possible danger in the external environment.

Figure 2:
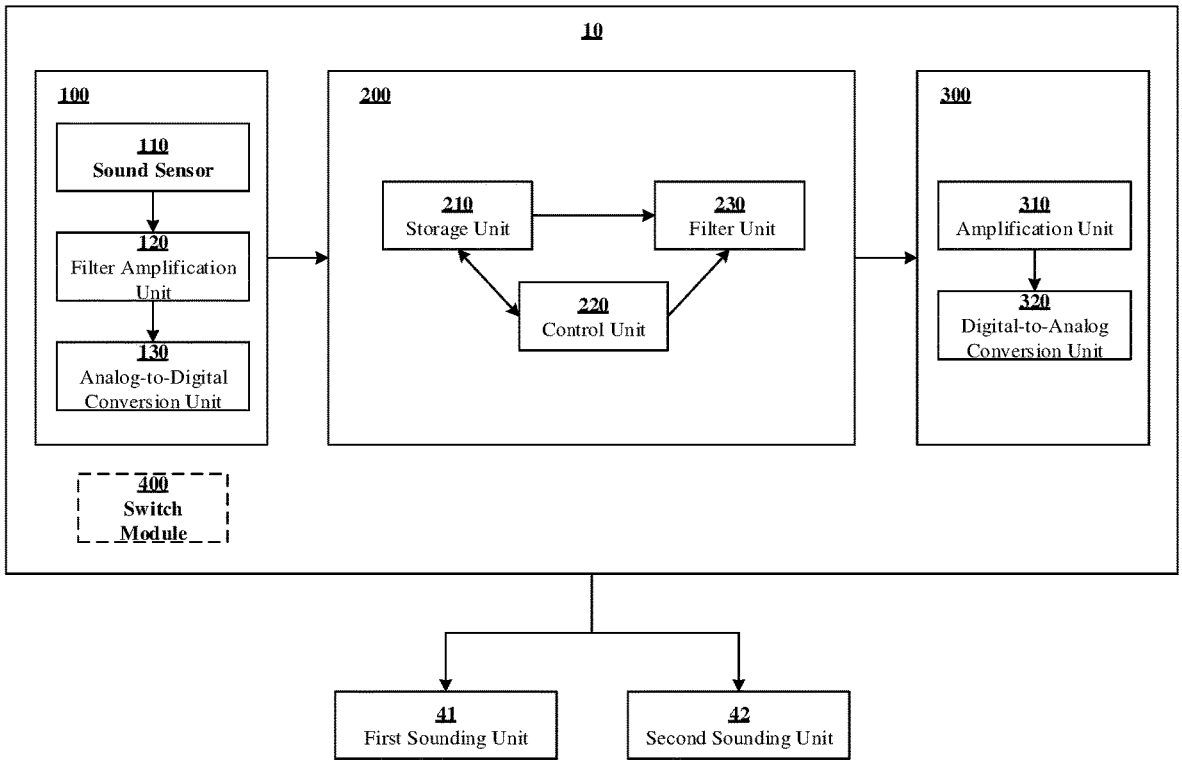
FIG. 2 is a schematic block diagram of each module in an earphone control device provided by an embodiment of the present disclosure.

For example, as shown in FIG. 2, an exemplary acquisition module 100 comprises a plurality of sound sensors 110, a filter amplification unit 120, and an analog-to-digital conversion unit 130.

For example, the plurality of sound sensors 110 may be symmetrically disposed at different positions on left and right sides of the earphone and configured to collect an external environment sound and output an analog sound signal. Each sound sensor 110 can be implemented by a microphone of a suitable type, for example, an MEMS microphone. A microphone is a transducer that converts sound into an electrical signal.

Figure 3:
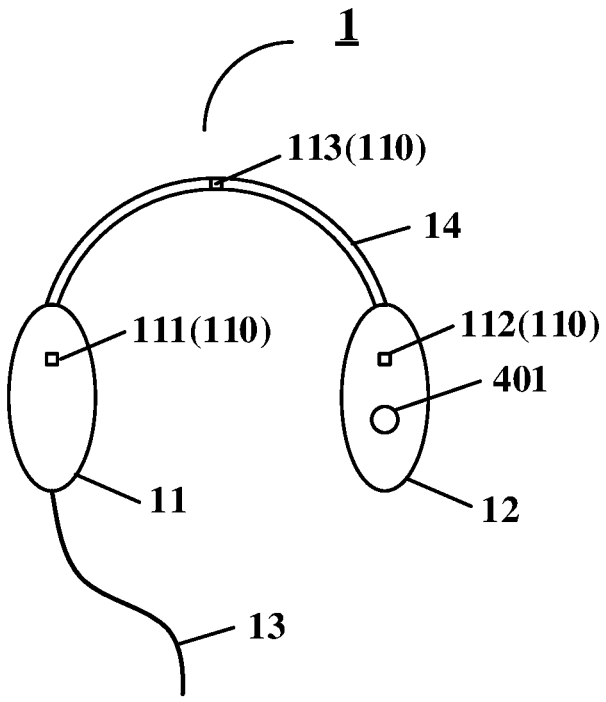
FIG. 3 is a schematic diagram of an earphone provided by an embodiment of the present disclosure.

For example, as shown in FIG. 3, the earphone 1 comprises a left earphone body 11, a right earphone body 12, an audio cable 13, and a connector 14. For example, the left earphone body 11 and the right earphone body 12 may be in various forms, and for example, each comprises a plastic case and various components disposed within the case; the connector 14 may be rigid, flexible, telescopic, etc. The sound sensors 110 are symmetrically disposed at different positions on the left and right sides of the earphone 1. An example comprising three sound sensors 110 is shown in FIG. 3, which are a first sensor 111, a second sensor 112 and a third sensor 113. For example, the first sensor 111 and the second sensor 112 may be respectively disposed at the symmetrical positions in the left earphone body 11 and the right earphone body 12. For example, holes can be respectively drilled in the cases of the left earphone body 11 and the right earphone body 12 to expose the first sensor 111 and the second sensor 112, so that the sensors can capture the sound in the external environment. For example, the third sensor 113 may be disposed at an intermediate position of the connector 14, that is, the third sensor 113 may also be symmetrical with respect to the earphone 1. Correspondingly, a hole can be drilled in the connector 14 to expose the third sensor 113. The above-mentioned holes can be made small so as not to disadvantageously affect the appearance of the earphone 1 as long as the sound sensors 110 can collect the external environment sound.

For example, the orientation of an abnormal sound source can be determined by the moments when the sound reaches the above three sensors, respectively.

It should be noted that three sound sensors 110 are shown in FIG. 3, and the embodiments of the present disclosure include, but are not limited to this example. For example, the third sensor 113 may not be provided, and only the first sensor 111 and the second sensor 112 are provided. Because the first sensor 111 and the second sensor 112 are symmetrically disposed on the left and right sides of the earphone 1, the orientation of the abnormal sound source can also be determined by the timing when the sound reaches the first sensor 111 and the second sensor 112, respectively. For another example, four, five or more sound sensors may also be symmetrically arranged on the earphone 1, which is not limited in the present disclosure.

FIG. 3 shows a headphone, and the embodiments of the present disclosure include but are not limited to this implementation. For example, in the case of providing two sound sensors 110, the earphone 1 may also be other types of earphone, for example, an earbud style earphone, and for another example, an earhook style earphone. The earphone 1 may not have the connector 14 in the case where the earphone 1 is the earbud style earphone or the earhook style earphone.

In addition, the earphone 1 may be wirelessly transmitted. In this case, the earphone 1 may not have the audio cable 13, which is not limited in this embodiment of the present disclosure. The way of wireless transmission includes but not limited to Bluetooth transmission.

For another example, the left sounding unit 41 may be disposed within the left earphone body 11 and the right sounding unit 42 may be disposed within the right earphone body 12.

For example, the sound sensor 110 collects an external environment sound and produces an analog sound signal, and outputs the analog sound signal to the filter amplification unit 120 in the next-stage. For example, the sound sensor 110 may be configured to be always working, or may be configured to start work when the user start to operation and stop working when the user pauses the operation.

For example, the filter amplification unit 120 is configured to filter and amplify the analog sound signal outputted by the sound sensor 110. For example, the filter amplification unit 120 may comprise a filter circuit and an amplification circuit.

For example, the filter circuit in the filter amplification unit 120 may comprise a filter group formed by a plurality of filters, or an integrated filter circuit or chip, and the form of the filter circuit is not limited in the present disclosure. Because the audible frequency range of the human ear ranges from 20 Hz to 20 kHz, the filter circuit in the filter amplifying unit 120 can filter out the sound signals of the analog sound signal the frequency range of which is outside the range of 20 Hz to 20 kHz and can not affect the sound quality of the earphone.

For example, the amplifying circuit in the filter amplifying unit 120 may comprise an amplifier group formed by multistage amplifiers, or an integrated amplifier circuit or chip, and the form of the amplifying circuit is not limited in the present disclosure. Because the sound signal will suffer from lose when the sound sensor 110 collects the sound signal or when the sound signal is transmitted over the line or cable, so the amplifying circuit amplifies the analog sound signals in order to facilitate the processing by a module or circuit in a subsequent stage.

It should be noted that, the filter amplification unit 120 may perform filtering on the analog sound signal firstly and then amplify the analog sound signal, or may perform amplifying of the analog sound signals firstly and then filter the analog sound signal, and the sequence is not limited in the present disclosure.

For example, the analog-to-digital conversion unit 130 is configured to convert the analog sound signal filtered and amplified by the filter amplification unit 120 into a digital sound signal, and the digital sound signal may be output to the processing module 200 for further processing. For example, the analog-to-digital conversion unit 130 may comprise an A/D conversion circuit or chip.

It should be noted that the amount of the filter amplification unit(s) 120 and the analog-to-digital conversion unit (s) 130 in the acquisition module 100 can be matched with the amount of the sound sensors 110. For example, as shown in FIG. 3, three sound sensors 110 are provided, and three filter amplification units and three analog-to-digital conversion units respectively corresponding to three sound sensors 110 are required correspondingly, that is, there are three signal processing paths, and each of the three signal processing paths comprises the sound sensor 110, filter amplification unit 120, and analog to digital conversion unit 130, which are connected in series. In addition, it should be noted that the filter amplification unit 120 and the analog-digital conversion unit 130 in the acquisition module 100 may be disposed in the left earphone body 11 or in the right earphone body 12, which is not limited in the present disclosure.

For example, as shown in FIG. 2, the processing module 200 comprises a storage unit 210 and a control unit 220. The storage unit 210 is configured to buffer the digital sound signals outputted by the acquisition module 100. The control unit 220 is configured to determine whether an abnormal sound is comprised in the digital sound signal and to identify the orientation of the abnormal sound source in the case where the abnormal sound is present.

For example, the storage unit 210 may be in various forms of computer-readable storage medium, such as magnetic storage medium or semiconductor storage medium. For example, the storage unit 210 may include a volatile memory and/or a non-volatile memory. The volatile memory may comprise, for example, a random access memory (RAM) and/or a cache, or the like. The non-volatile memory may comprise, for example, a read only memory (ROM), a flash memory, or the like.

For example, the storage unit 210 may comprise a plurality of buffers for respectively buffering the many digital sound signals outputted by the acquisition module 100, and each of the buffers corresponds to one path of digital sound signal. One or more pieces of computer program instructions may be stored in the storage unit 210, and the control unit 220 can execute the program instructions to determine whether the abnormal sound is comprised in the digital sound signals and to identify the orientation of the abnormal sound source in the case where the abnormal sound is present. In addition, various data may also be stored in the storage unit 210, which comprises data to be processed and data generated through the processing, and for example, the data may be the above-mentioned pre-recorded prompt tone. When the prompt tone needs to be output, the control unit 220 can directly execute the program instructions for the prompt tone from the storage unit 210.

For example, the control unit 220 may be a central processing unit (CPU) or other form of control unit or control circuit having data processing capability and/or instruction execution capability. For example, the control unit 220 may be a microprocessor, or may also be a DSP (Digital Signal Processing) chip, an FPFA (Field-Programmable Gate Array) chip, a programmable logic controller (PLC), or the like. The processor may be in various architectures, for example, an X86 processor or an ARM processor. The control unit 220 may execute the program instructions stored in the storage unit 210 to determine whether an abnormal sound is comprised in the digital sound signal and to identify the orientation of the abnormal sound source in the case where the abnormal sound is present.

For example, when the control unit 220 recognizing the orientation of the abnormal sound source, the control unit 220 may output a control signal to the output module 300 for controlling to output the prompt tone to the first sounding unit 41 or/and the second sounding unit 42. The corresponding relationship between the orientation of the abnormal sound source and the sounding unit may refer to the above corresponding description, and details are not repeated herein again.

For example, the storage unit 210 may be integrated with the control unit 220 in a card, such as an FPGA card. The FPGA card may be provided thereon with an FPGA chip, a memory chip, a digital sound signal input port, and the like. Of course, the on-chip memory space of the FPGA chip may be used as the memory unit 210 without providing an independent memory chip, which is not limited in the present disclosure.

For example, as shown in FIG. 2, in an example, the processing module 200 may further comprise a filtering unit 230, and the filtering unit 230 is configured to filter out other sound signals than the abnormal sound of the digital sound signal.

For example, when the control unit 220 determines that an abnormal sound signal is comprised in the digital sound signal buffered in the storage unit 210, the control unit 220 may extract the frequency information of the abnormal sound signal and output the control signal to the filter unit 230 to filter out other sound signals than the abnormal sound in the digital sound signal. For example, the abnormal sound outputted by the filter unit 230 may be transmitted to the output module 300 such that the prompt tone comprises the abnormal sound.

For example, the filtering unit 230 comprises a variable bandwidth filter, which can adjust the filtering bandwidth according to the control signal of the control unit 220, so as to implement the function of extracting the abnormal sound signal.

For example, as shown in FIG. 2, the output module 300 may comprise an amplification unit 310 and a digital-to-analog conversion unit 320. For example, the amplifying unit 310 may comprise an amplifier group formed by amplifiers in stages, and may also be an integrated amplifier circuit or chip, which is not limited in the present disclosure. The amplification unit 310 amplifies the prompt tone to improve the amplitude of the sound, which can better remind the user to avoid danger.

For example, the digital-to-analog converting unit 320 converts the digital sound signal amplified by the amplifying unit 310 into the analog sound signal for outputting to the sounding unit of the earphone. For example, the digital-to-analog conversion unit 320 may comprise a D/A conversion circuit or chip.

In the earphone control device 10 provided by at least one embodiment of the present disclosure, as shown in FIG. 2, a switch module 400 configured to turn on/off the earphone control device 10 may further be comprised. The switch module 400 is configured to turn on/off the earphone control device 10. For example, the switch module 400 may comprise a mechanical button, an electric button, or the like. For example, the electric button may comprise a photoelectric button or a capacitive button.

For example, as shown in FIG. 3, a capacitive button 401 is provided on the case of the right earphone body 12 of the earphone 1. The capacitive button 401 is a small capacitive button, and a corresponding sensing touch area, which is called as a sensing plate, is provided on the case of the earphone. The sensing plate indicates the position of the capacitive button 401. The sensing plate is made of a high-density non-conductive material such as plastic or glass. For example, PMMA (organic glass), which is commonly used in electronic devices, is transparent, and a built-in LED is provided and can emit light when the sensing plate is touched, which can bring the prompt and beautiful effect simultaneously.

The capacitive button is equivalent to a small integrated circuit that can be placed under any media. When a user (finger) touches the sensor, a capacitor is produced between the sensor and the earth because the human body is equivalent to a capacitor connected to the earth. In this principle, a detection circuit is provided outside the small integrated circuit, and it can be detected whether there is human touching on the sensor plate according to the change of the capacitance.

It should be noted that the position of the capacitive button 401 are not limited in the embodiments of the present disclosure. For example, the capacitive button 401 may also be disposed on the case of the left earphone body 11, or capacitive buttons are provided on the cases of both the left earphone body and the right earphone body.

With the switch module 400, when the user uses the earphone in a relatively safe environment such as home, the earphone control device 10 can be turned off; when the user uses the earphone in an outdoor environment such as roads that may be in danger, the earphone control device 10 may be turned on.

In the above-described way, the user can turn on or turn off the earphone control device at any time according to their needs, which can save power and reduce power consumption compared with the case that the earphone control device is always in operation.

In addition, the earphone control device 10 may further comprise a power module (not shown in FIG. 2) for supplying power to each of the components of the earphone control device. Of course, in a case where the earphone 1 has a power module, the earphone control device 10 can have electricity from the power module of the earphone 1, and thus the earphone control device need not to have a power module by itself. The power module may comprise a built-in battery or may comprise a battery compartment for facilitating the replacement of battery. The battery may be a primary battery or a secondary battery, and the secondary battery may be a lithium-ion battery and the like. The power module may further comprise a solar cell and so on.

The earphone control device provided by this embodiment collects external environment sounds and determines whether an abnormal sound is comprised in the external environment sounds after processing the external environment sounds and outputs a prompt tone to the sounding unit of the earphone in the case where the abnormal sound is present so that the user can hear a prompt message. The sound control device can remind the user to pay attention to the abnormal sound in the external environment and avoid possible dangers.

In the earphone control device provided by at least one embodiment, the earphone control device may further recognize the orientation of the abnormal sound source, and output the prompt tone to the corresponding earphone sounding unit according to the orientation of the abnormal sound source. This function of the earphone can remind the users of the orientation of the danger source, so that users can better avoid the possible dangers.

In the earphone control device provided by at least one embodiment, the earphone control device may further extract the abnormal sound, and the resultant can be output to the sounding unit of the earphone was after being amplified. By this way, the prompt tone comprising the abnormal sound can be directly output to the user, so that user can be intuitively reminded, allowing the use to better avoid the possible dangers in the external environment.

In the earphone control device provided by at least one embodiment, the earphone control device may further recognize the orientation of the abnormal sound source and extract the abnormal sound, and then output the prompt tone comprising the abnormal sound to the corresponding earphone sounding unit according to the orientation of the abnormal sound source. By this way, the user can be reminded of the orientation of the danger source and the prompt tone comprising the abnormal sound can be directly output to the user, and thereby enabling the user to better recognize and avoid possible dangers in the external environment.

Figure 4:
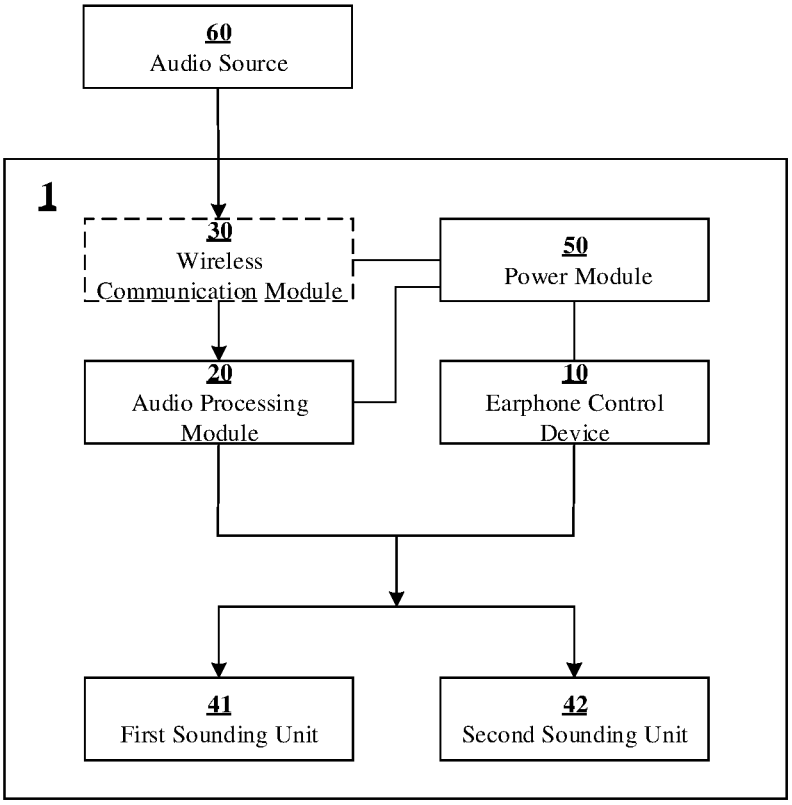
FIG. 4 is a schematic block diagram of each of the modules in an earphone provided by an embodiment of the present disclosure.

Another embodiment of the present disclosure provides an earphone 1, as shown in FIG. 3 and FIG. 4, which comprises the earphone control device 10 provided by any one of the above-described embodiments.

For example, as shown in FIG. 3, the earphone 1 comprises a left earphone body 11, a right earphone body 12, an audio cable 13, and a connector 14. FIG. 3 shows a headset, and embodiments of the present disclosure include but are not limited to this form. For example, the earphone 1 can also be of other types, for example an earbud style earphone, and for another example an earhook style earphone. It should be noted that the earphone 1 may not have the connector 14 in the case where the earphone 1 is the earbud style earphone or the earhook style earphone.

For example, as shown in FIG. 4, the earphone 1 may further comprise a first sounding unit 41 and a second sounding unit 42. The first sounding unit 41 and the second sounding unit 42 may refer to the corresponding description of the above-described corresponding embodiment(s), and details are not described herein again. The first sounding unit 41 and the second sounding unit 42 each may be implemented by a speaker of a suitable type. A speaker is an electroacoustic transducer which converts an electrical audio signal into a corresponding sound, and for example, which causes a diaphragm (usually conically shaped) attached to a coil to move back and forth, pushing on surrounding air to create sound waves.

For example, as shown in FIG. 4, the earphone 1 may further comprise an audio processing module 20, a power module 50, and a wireless communication module 30. For example, the audio signal of the audio source 60 is processed by the audio processing module 20 and output to the first sounding unit 41 and the second sounding unit 42. For example, the power module 50 can supply electricity to the earphone control device 10, the audio processing module 20 and the wireless communication module 30.

It should be noted that, the earphone 1 may adopt a wired signal transmission method. In this case, the audio source 60 transmits the audio signal to the audio processing module 20 through the audio cable 13. The earphone 1 may also adopt a wireless signal transmission (for example, Bluetooth, WIFI network, 3G/4G/5G cellular network, or ZigBee network, and the like) method, in which case the earphone 1 does not have the audio cable 13; of course, in this example, the audio cable 13 may also be reserved so that the earphone 1 has the functions of wired and wireless signal transmission. The means of signal transmission is not limited in the embodiments of the present disclosure.

For example, the audio source 60 may be a portable electronic device such as a cell phone, smart watch, music player, or any other audio output device.

For example, when the earphone 1 provided in this embodiment is operating, and when the earphone control device 10 is turned on, if the earphone controller 10 determines that there is no abnormal sound in the external environment, the user can normally listen to the audio output from the audio source. When the earphone control device 10 determines that there is an abnormal sound in the external environment, the earphone 1 can pause the audio output from the audio source and output only the prompt tone to the user. Certainly, the audio output from the audio source and the prompt tone may also be output to the user simultaneously, which is not limited in the embodiments of the present disclosure.

The technical effect of the earphone provided by this embodiment when the earphone control device is turned on may refer to the corresponding description of the above embodiments, and details are not described herein again. When a user turns off the earphone control device, the earphone can be used as a regular earphone without affecting its basic functions.

Figure 5:
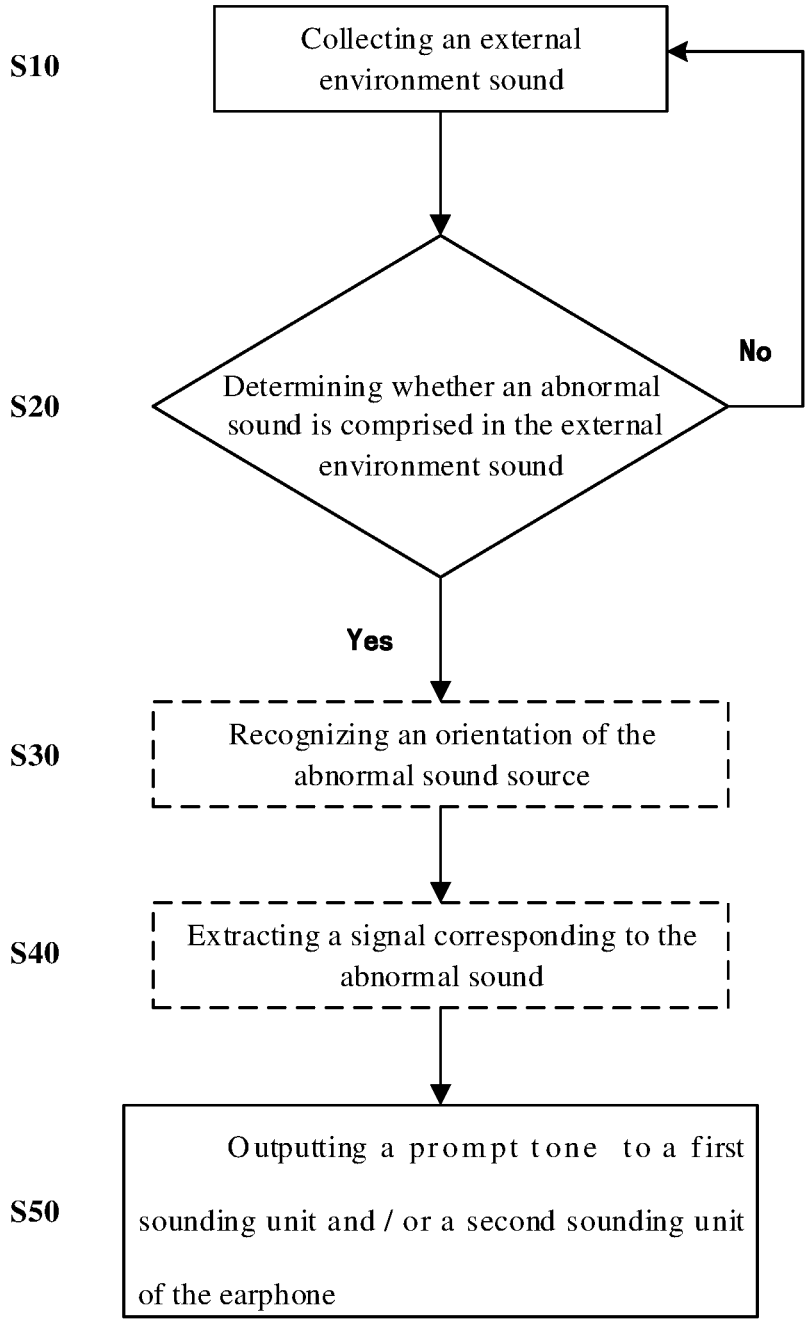
FIG. 5 is a flowchart of a control method for an earphone provided by an embodiment of the present disclosure.

An example of another embodiment of the present disclosure provides a control method for the earphone. As shown in FIG. 5, the method comprises the following steps.

Step S10: collecting an external environment sound.

Step S20: determining whether an abnormal sound is comprised in the external environment sound.

Step S50: outputting a prompt tone to a first sounding unit and/or a second sounding unit of the earphone.

In step S10, for example, as shown in FIG. 1 and FIG. 2, the collecting module 100 collects the external environment sound or sounds and outputs the digital sound signal. For example, step S10 may comprises: collecting the external environment sound by using a plurality of sound sensors 10 and outputting analog sound signals; filtering and amplifying the analog sound signals by using the filter amplification unit 120; and converting the filtered and amplified the analog sound signals into digital sound signals by using the analog-to-digital conversion unit 130. The sound sensor 110, the filter amplification unit 120, and the analog-to-digital conversion unit 130 may refer to the corresponding descriptions of the above-described embodiment, and details are not described herein again.

In step S20, if it is determined that an abnormal sound is comprised in the external environment sound, step S50 is performed. If it is determined that no abnormal sound is comprised in the external environment sound, step S10 is repeated to continue to collect the external environment sound.

In step S50, the prompt tone may be output to the first sounding unit or the second sounding unit of the earphone, or the prompt tone may be output to the first sounding unit and the second sounding unit of the earphone simultaneously. The prompt tone, the first sounding unit and the second sounding unit may refer to the corresponding descriptions in the above embodiment, and details are not described herein again.

A specific implementation example of step S20 will be described below. It should be noted that an example of the acquisition module 100 comprising three sound sensors is described in this embodiment.

Figure 6:
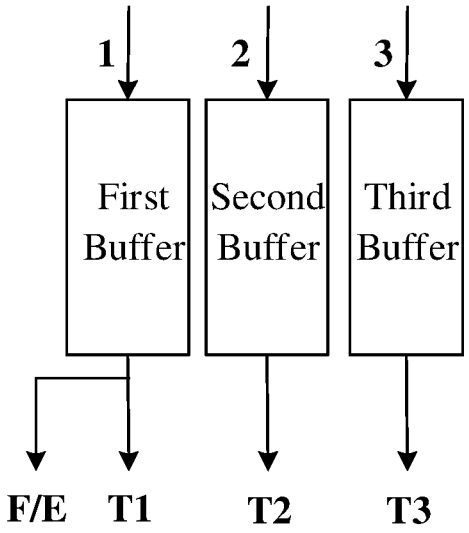
FIG. 6 is a schematic diagram of feature extraction and calculation of digital sound signals data in a buffer in a control method for an earphone provided by an embodiment of the present disclosure.

For example, as shown in FIG. 6, three paths of digital sound signals (indicated by numbers 1, 2, and 3, respectively) output by the acquisition module 100 are respectively buffered into three buffers of the same size. The first buffer corresponds to the first sensor 111 disposed in the left earphone body 11 in FIG. 3, the second buffer corresponds to the second buffer corresponds to the second sensor 112 disposed in the right earphone body 11 in FIG. 3, the third buffer corresponds to the third buffer corresponds to the third sensor 113 disposed in the connector 14 in FIG. 3. Each buffer may be implemented by an individual memory or by different areas of a memory.

It should be noted that the buffer is usually used to temporarily store digital sound signal data, and new data can overwrite the stored data when the new data is input. For example, the size of the buffer may be 20 Kb~100 Kb, and the size of the buffer may be set according to actual needs, which is not limited in the present disclosure.

For example, as shown in FIG. 6, the digital sound signal data in the three buffers are respectively subjected to feature extraction and calculation.

For example, the first buffer will be described as an example. The sound signal collected by the first sensor 111 is converted into the digital sound signal and then buffered into the first buffer, and then the three eigenvalues of the digital sound signal stored in the first buffer, comprising the frequency, the amplitude and the phase, are extracted to finally obtain a three-dimensional spectrum of time, frequency and energy values.

The above three-dimensional spectrum is further processed, and one energy value is extracted at each of the fixed time intervals T, and N points are continuously obtained, for example, T is 10 milliseconds and N is 1000. The values of T and N are related to the size of the buffer, which is not limited in the present disclosure. For example, when a new energy value is extracted each time, an average value of all currently extracted energy values is taken as the environmental noise reference value En, and the environmental noise reference value En is updated when the new energy value is extracted for example. For example, when the second point is extracted, the average of the energy values of the first two points is taken as the environmental noise reference value En; when the third point is extracted, the average of the energy values of the first three points is taken as the environmental noise reference value En; and so on, when the n(th) point is extracted, the average of the energy values of the first n points is taken as the environmental noise reference value En (here n is an integer greater than zero and less than N). When the energy value extracted is greater than the product of the environmental noise reference value En and a reference coefficient K, it is determined that the current extracted point is an abnormal sound point, that is, the sound signal input to the buffer comprises the abnormal sound. In a case where it is determined that the sound signal of the input buffer comprises the abnormal sound, the time corresponding to the point with the largest energy value among the N points extracted in the buffer is recorded as T1, the corresponding frequency range is recorded as F, and the maximum energy value is recorded as E.

For the digital sound signal data buffered in the same process, the data in the second buffer and the third buffer are also extracted and calculated according to the above method to respectively obtain T2 and T3 for identifying the orientation of the abnormal sound source in the subsequent process.

It should be noted that, with respect to the above manner of updating the environmental noise reference value En, the embodiments of the present disclosure include, but not limited to, the foregoing examples.

For example, when the data in the buffer is updated, the average of the energy values of the N points in the buffer may be directly calculated as the environment noise reference value En, and the environmental noise reference value En is not updated when N points in this buffer is determined. When the data is buffered in the buffer in the next time, the average of the energy values of the N points in the current buffer is calculated as a new environmental noise reference value En, and then the N points in the buffer is determined according to the updated environmental noise reference value En.

For example, the reference coefficient K may be a fixed value, for example, K is equal to 2; for another example, the reference coefficient K may be modified according to the environmental noise reference value En. For example, the environmental noise reference value on a road differs greatly from the environmental noise reference value in a library. In this case, the reference coefficient K may be adjusted according to the range of the environmental noise reference value En.

For example, the above step S20 may be implemented by the control unit 220 in FIG. 2 executing program instructions stored in the storage unit 210. For example, the corresponding relationship between the reference coefficient K and the environmental noise reference value En may be stored in the storage unit 210 in advance, and the control unit 220 can directly call the relationship when the relationship is needed.

The control method for the earphone provided by this example collects the external environment sound and determines whether the abnormal sound is comprised in the external environment sound after processing the external environment sound and outputs the prompt tone to the sounding unit of the earphone in the case where the abnormal sound is present so that the user can hear the prompt message. The control method for the earphone can remind the user to pay attention to the abnormal sound in the external environment and avoid possible dangers.

For example, in the control method for the earphone provided by another example of this embodiment, as shown in FIG. 5, the method may further comprise the following steps based on the previous example.

Step S30: identifying the orientation of the abnormal sound source.

Specifically, the orientation of the abnormal sound source can be identified by a time delay method, that is, the orientation of the abnormal sound source is identified according to the moments when the abnormal sound reaches the plurality of sound sensors, where the moments are T1, T2 and T3 described in above embodiment. For example, on the basis of the previous example, the identification method is as follows:

a) If T1<T2 and T1<T3, it is determined that the orientation of the abnormal sound source is closer to the first sensor, that is, the orientation of the abnormal sound source is on the left of the user;

b) If T2<T1 and T2<T3, it is determined that the orientation of the abnormal sound source is closer to the second sensor, that is, the orientation of the abnormal sound source is on the right of the user; and c) In other states, it is determined that the orientation of the abnormal sound source is closer to the third sensor, that is, the orientation of the abnormal sound source is directly in front of or behind the user.

For another example, when the acquisition module 100 comprises two sound sensors, that is, only the first sensor and the second sensor are provided, and the first sensor and the second sensor are symmetrically disposed in the left earphone body and the right earphone body, respectively. In this case, the identification method is as follows:

a) If T2-T1>Te, it is determined that the orientation of the abnormal sound source is closer to the first sensor, that is, the orientation of the abnormal sound source is on the left of the user;

b) If T1-T2>Te, it is determined that the orientation of the abnormal sound source is closer to the second sensor, that is, the orientation of the abnormal sound source is on the right of the user; and c) If |T1-T2|≤Te, it is determined that the orientation of the abnormal sound source is directly in front of or behind the user.

Te is a judgment time error value, that is, as long as the absolute value of the difference between T1 and T2 is within this error range, it is determined that the orientation of the sound source is directly in front of or behind the user. The size of Te is set according to actual needs, which is not limited in the present disclosure.

In the case where the step S30 is comprised, the step S50 comprises: outputting the prompt tone to the first sounding unit and/or the second sounding unit of the earphone according to the orientation of the abnormal sound source.

For example, when it is identified that the orientation of the abnormal sound source is on the left side of the user, the prompt tone is output to the left sounding unit of the earphone; when it is identified that the orientation of the abnormal sound source is on the right of the user, the prompt tone is output to the right sounding unit of the earphone; and when it is identified that the orientation of the abnormal sound source is directly in front of or behind the user, the prompt tone is output to both the left sounding unit and the right sounding unit of the earphone simultaneously.

By identifying the orientation of the abnormal sound source and outputting the prompt tone to the corresponding sounding unit of the earphone according to the orientation of the abnormal sound source, the user can be prompted with the orientation of the danger source so that the user can better avoid the possible dangers.

For example, in the control method for the earphone provided by another example of this embodiment, as shown in FIG. 5, the method may further comprise the following steps based on the previous example.

Step S40: extracting the signal corresponding to the abnormal sound.

Specifically, the filtering unit may be used to filter out other sound signals in the digital sound signals except for the abnormal sound.

For example, in the above example, the frequency range F corresponding to the abnormal sound signal may be obtained by feature extraction and calculation. Then, the control unit 220 shown in FIG. 2 may output the control signal to the filtering unit 230 according to the frequency range F of the abnormal sound signal to extract the signal corresponding to the abnormal sound.

For example, the filtering unit 230 comprises a variable bandwidth filter, which can adjust the filtering bandwidth according to the control signal of the control unit 220, so as to implement the function of extracting the abnormal sound signal.

In the case of comprising the step S40, the prompt tone outputted in step S50 may only comprise the digital sound signal corresponding to the abnormal sound, or the prompt tone may also comprise a pre-recorded artificial sound or a machine sound. This embodiment of the present disclosure is not limited to this.

By extracting the abnormal sound and outputting the abnormal sound to the sounding unit of the earphone, the prompt tone comprising the abnormal sound can be directly output to the user, so that the user can be intuitively reminded to allow them to better avoid the possible dangers in the external environment.

For example, in the control method for the earphone provided in another example of this embodiment, as shown in FIG. 5, steps S30 and S40 may be simultaneously comprised. In this case, the orientation of the abnormal sound source can be identified and the abnormal sound can be extracted, and then the prompt tone comprising the abnormal sound can be output to the corresponding sounding unit of the earphone according to the orientation of the abnormal sound source, so user can better avoid the possible dangers in the external environment.

It should be noted that, as shown in FIG. 5, in the control method for the earphone provided in this embodiment, on the basis of performing steps S10, S20 and S50, steps S30 and S40 may be performed separately or in combination. For example, step S30 may be performed before step S40, or step S40 may be performed before step S30. This embodiment of the present disclosure is not limited thereto.

What are described above is related to the illustrative embodiments of the disclosure only and not limitative to the scope of the disclosure; the scopes of the disclosure are defined by the accompanying claims.

What is claimed is:

1. An earphone control device, adaptable for an earphone, comprising:

an acquisition module, configured to collect an external environment sound;

an output module, configured to output a prompt tone to a first sounding unit and/or a second sounding unit of the earphone; and a processing module, configured to determine whether an abnormal sound is comprised in the external environment sound and control the output module to output the prompt tone in a case where the abnormal sound is present, wherein when performing a step of determining whether the abnormal sound is comprised in the external environment sound, the processing module is configured to:

convert the external environment sound collected by the acquisition module into digital sound signals and input the digital sound signals into a fixed-sized buffer;

extract an energy value of a digital sound signal of the digital sound signals every fixed time interval;

calculate an average value based on all enemy values which have been extracted at a current moment each time the energy value is extracted, and use the average value as an environment noise reference;

determine whether the energy value extracted at the current moment is greater than a product of the environmental noise reference and a reference coefficient;

when yes, determine that an extracted point corresponding to the energy value extracted at the current moment is an abnormal sound point, and that external environment sound corresponding to a digital sound signal input into the fixed-size buffer and corresponding to the abnormal sound point comprises the abnormal sound.

2. The earphone control device according to claim 1, wherein the acquisition module comprises a plurality of sound sensors, a filter amplification unit, and an analog-to-digital conversion unit;

the plurality of sound sensors are disposed at different positions on left and right sides of the earphone and configured to collect the external environment sound and output analog sound signals, the filter amplification unit is configured to filter and amplify the analog sound signals, and the analog-to-digital conversion unit is configured to convert the filtered and amplified analog sound signals into the digital sound signals.

3. The earphone control device according to claim 2, wherein the processing module comprises a storage unit and a control unit;

the storage unit is configured to buffer the digital sound signals, and the control unit is configured to determine whether the abnormal sound is comprised in the digital sound signals and to identify the orientation of the abnormal sound source in the case where the abnormal sound is present.

4. The earphone control device according to claim 3, wherein the processing module further comprises a filtering unit, and the filtering unit is configured to filter out other sound signals in the digital sound signals except the abnormal sound.

5. An earphone, comprising the earphone control device according to claim 1.

6. The earphone control device according to claim 1, wherein the processing module is further configured to identify an orientation of the abnormal sound source in the case where the abnormal sound is present, and the output module is configured to output the prompt tone to the first sounding unit and/or the second sounding unit of the earphone according to the orientation of the abnormal sound source.

7. The earphone control device according to claim 1, wherein the processing module is further configured to extract a signal corresponding to the abnormal sound and output the signal corresponding to the abnormal sound to the output module such that the prompt tone comprises the abnormal sound.

8. A control method for an earphone, comprising:

collecting an external environment sound;

determining whether an abnormal sound is comprised in the external environment sound;

outputting a prompt tone to a first sounding unit and/or a second sounding unit of the earphone in the case where the abnormal sound is present;

eliminating a part of the external environment sound except the abnormal sound in a case where the abnormal sound is comprised in the external environment sound;

wherein determining whether the abnormal sound is comprised in the external environment sound comprises:

converting the external environment sound collected by the-acquisition module into digital sound signals and inputting the digital sound signals into a fixed-size buffer;

extracting an energy value a digital sound signal of the digital sound signals every fixed time internal;

calculating an average value based on all energy values which have been extracted at a current moment each time the energy value is extracted, and using the average value as an environment noise reference;

determining whether the energy value extracted at the current moment is greater than a product of the environmental noise reference and a reference coefficient;

when yes, determining that an extracted point corresponding to the energy value extracted at the current moment is an abnormal sound point, and that external environment sound corresponding to a digital sound signal input into the fixed-size buffer and corresponding to the abnormal sound point comprises the abnormal sound.

9. The control method for the earphone according to claim 8, wherein the collecting of the external environment sound comprises:

collecting the external environment sound by using a plurality of sound sensors and outputting analog sound signals;

filtering and amplifying analog sound signals by using a filter amplification unit; and converting the filtered and amplified analog sound signals into the digital sound signals by using an analog-to-digital conversion unit.

10. The control method for the earphone according to claim 8, wherein, the environmental noise reference value is updated according to the energy value of the digital sound signals which have been input into the buffer at the certain moment; and the reference coefficient is modified according to the environmental noise reference value;

wherein the control method for the earphone further comprises: extracting a frequency range corresponding to the abnormal sound in a case where it is determined that the external environment sound comprises the abnormal sound.

11. The control method for the earphone according to claim 10, wherein eliminating a part of the external environment sound except the abnormal sound in a case where the abnormal sound is comprised in the external environment sound and extracting of the signal corresponding to the abnormal sound from the external environment sound comprises:

using a filtering unit to filter out other sound signals in the digital sound signals except the abnormal sound according to the frequency range.

12. The control method for the earphone according to claim 8, further comprising:

recognizing an orientation of the abnormal sound source;

wherein outputting of the prompt tone to the first sounding unit and/or the second sounding unit of the earphone comprises: outputting the prompt tone to the first sounding unit and/or the second sounding unit of the earphone according to the orientation of the abnormal sound source.

13. The control method for the earphone according to claim 12, wherein recognizing of the orientation of the abnormal sound comprises:

recognizing the orientation of the abnormal sound source according to moments at which the abnormal sound reaches the plurality of sound sensors, respectively.

14. The control method for the earphone according to claim 8, further comprising:

extracting a signal corresponding to the abnormal sound; and outputting the signal corresponding to the abnormal sound to the first sounding unit and/or the second sounding unit of the earphone such that the prompt tone comprises the abnormal sound.

* * * * *